United States Patent [19]

Dillingham

[11] Patent Number: 4,944,632

[45] Date of Patent: Jul. 31, 1990

[54] DEVICE FOR DISPENSING ASPHALT REPAIR MATERIALS

[76] Inventor: Harold W. Dillingham, P.O. Box 661, Jacksonville, Tex. 75766

[21] Appl. No.: 310,940

[22] Filed: Feb. 16, 1989

[51] Int. Cl.[5] ..... E01C 19/06; E01C 19/18

[52] U.S. Cl. ..... 404/111; 404/101

[58] Field of Search ..... 404/111, 108–110, 404/75, 101; 222/146.2, 626, 318; 239/127, 124, 146; 366/133, 279

[56] References Cited

U.S. PATENT DOCUMENTS

| | | | |
|---|---|---|---|
| 2,267,978 | 12/1941 | Ionides | 404/111 |
| 4,196,827 | 4/1980 | Leafdale | 404/111 X |
| 4,247,022 | 1/1981 | Fung et al. | 222/318 X |
| 4,311,274 | 1/1982 | Neal | 404/111 X |
| 4,661,684 | 4/1987 | Sellers | 404/111 X |
| 4,680,937 | 7/1987 | Young | 239/127 X |
| 4,695,186 | 9/1987 | King | 404/111 |
| 4,828,429 | 5/1989 | Kirchner et al. | 404/111 |

*Primary Examiner*—Jerome W. Massie
*Assistant Examiner*—Gay Ann Spahn
*Attorney, Agent, or Firm*—Charles D. Gunter, Jr.

[57] ABSTRACT

A portable device is shown for transporting asphalt repair materials for use in repairing potholes in asphalt pavements. The device has a body with a hopper compartment for transporting and dispensing asphalt mix materials. A separate tack oil tank is provided with an internal circulation system for maintaining liquid tack oils in an emulsified state.

12 Claims, 2 Drawing Sheets

DEVICE FOR DISPENSING ASPHALT REPAIR MATERIALS

BACKGROUND OF THE INVENTION

1. Field of the Invention

This invention relates generally to truck and/or trailer mounted portable devices for dispensing pavement repair materials, and specifically to such a portable device for dispensing tack oils used for repairing asphalt pavements.

2. Description of the Prior Art:

In the past, as many as three vehicles were sometimes needed to repair openings and potholes in asphalt pavements. One vehicle provided an air compressor for use with various pneumatic repair tools which were used to dress the hole or cavity to be filled. Another vehicle contained liquid asphalt tack material which would be sprayed into the dressed cavity, and a third vehicle would deliver asphalt mix material to the cavity. The asphalt would then be raked, compacted and leveled by hand to complete the repair.

U.S. Pat. No. 4,196,827, issued Apr. 8, 1980, entitled, "Portable Machine for Transporting Heated Asphalt Products for Use in Repairing Asphalt Pavement" shows a portable machine which was designed to incorporate all phases of the pavement repair into one mobile unit. The machine has a hopper for transporting asphalt mix, and has a reservoir below the hopper having a heat source. The reservoir contains liquid asphalt tack material. The heat source is used to heat the liquid tack material, and the tack material is used to heat the asphalt mix in the hopper by heat transfer. Asphalt tack material is also dispensed from the tack material tank by means of spray equipment connected to a discharge valve on the rear of the truck.

In spite of being less expensive to operate in terms of material and labor, the foregoing device possessed several disadvantages. Although the liquid asphalt tank is suitable for road oils and cutbacks, the liquid asphalt tank is not well suited for use with asphaltic cements. In addition, the liquid asphalt tank is not suited for use with asphalt emulsions, because the volatile contents of the emulsions would be driven off and dry out the material.

In order to overcome the above shortcomings, especially with respect to tack oils, mobile units have been provided with the tack oil tank located separately but on a common base with the hopper unit. The tack oil tank could then conveniently be supplied with its own heat source, specifically designed for the heat characteristics of emulsion oils and liquid asphalt oils.

In spite of these improvements, a problem sometimes occurs with separation of the tack oils contained in the separate tack oil tank. These oils are generally petroleum and animal fat products that are emulsified. Most such oils are intended for immediate use or otherwise the water content of the oil separates from the base material. Previously, the materials were remixed for use by using the spray applicator pump to recirculate the materials within the tank, or the materials were manually remixed. Both methods were inefficient and time consuming.

A need exists, therefore, for an improved method and apparatus for dispensing tack oil which prevents phase separation of the tack oil materials.

SUMMARY OF THE INVENTION

The tack oil dispensing apparatus of the invention includes a tack oil tank adapted to be mounted on a portable base for transporting the tank to a repair site. The tack oil tank has a bottom wall, a top wall and interconnecting sidewalls which together define a closed interior having a bottom region and a top region, respectively. The closed interior is supplied with a preselected level of tack oil, the level being below that of the top wall.

Circulating means within the tack oil tank continuously recirculate tack oil from the bottom portion of the closed interior to the top portion thereof. Preferably, the circulating means include dispensing means for dispensing the recirculated tack oil downwardly within the tank interior onto the top of the liquid level therein, to thereby maintain the tack oils within the tank in an emulsified state. Heat transfer means located within the tack oil tank heat the tack oil to maintain the tack oil in a liquid state.

Additional objects, features and advantages will be apparent in the written description which follows.

DETAILED DESCRIPTION OF THE INVENTION

Figure 1:
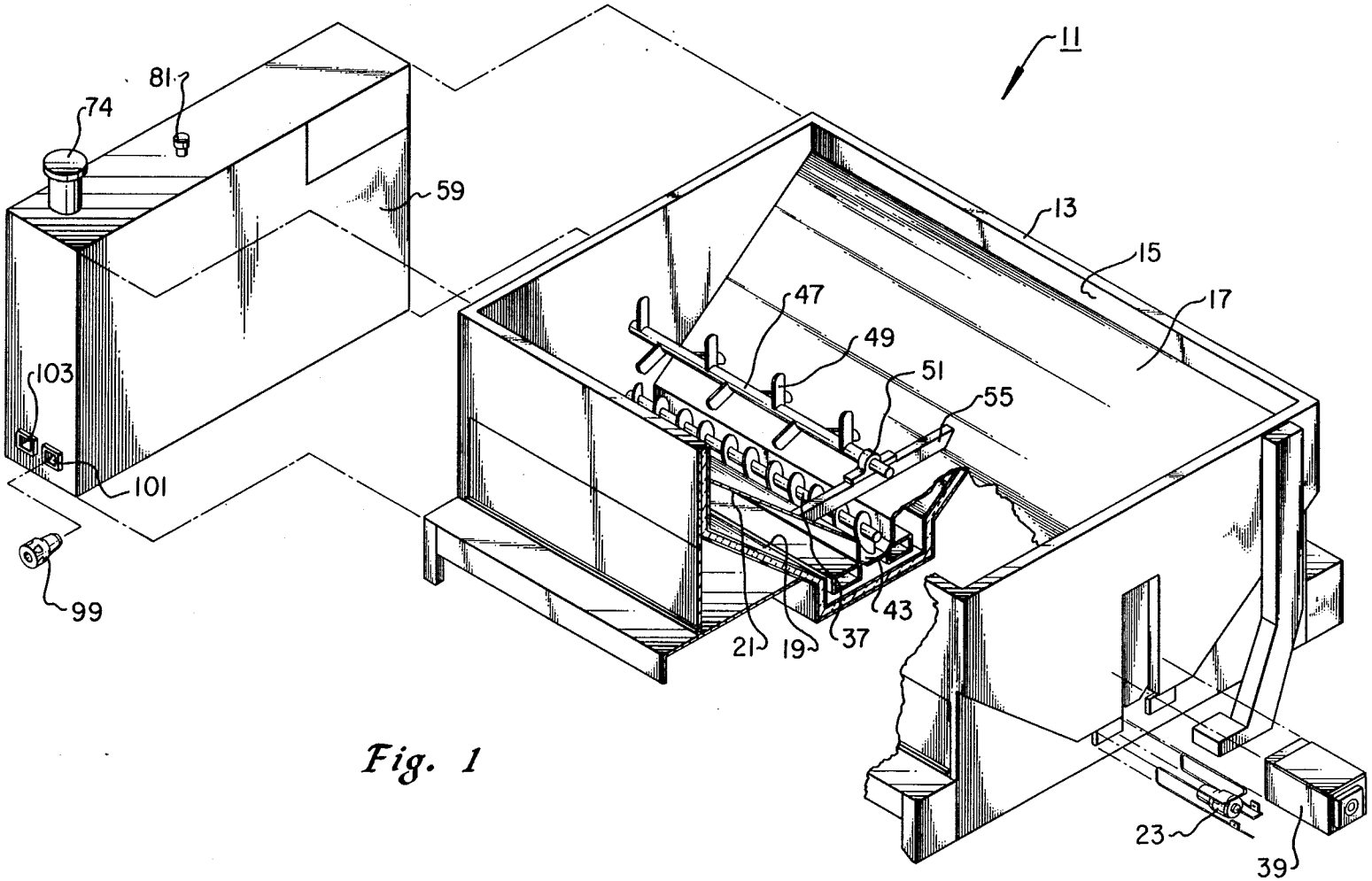
FIG. 1 is an assembly view, partly broken away, of the apparatus of the invention showing the asphalt mix hopper and the separate tack oil tank used to dispense repair materials.

Turning to FIG. 1, there is shown a portable device for transporting asphalt repair materials of the invention, designated generally by the numeral 11. The device 11 includes a body 13 which is generally rectangular in shape and which is adapted to be mounted upon the bed of a truck, or upon a trailer which would be towed by a vehicle and a separate tack oil tank 59. The truck or trailer would serve as a portable base for transporting the body 13 and tack oil tank 59 to a repair site for repairing a pothole in an asphalt pavement.

As best seen in FIG. 1, the body 13 has a hopper compartment 15 with a V-shaped bottom wall 17 for transporting asphalt mix materials. In this discussion, "asphalt mix" materials will be taken to mean pre-mix or aggregate hot or cold mix asphalt and asphalt aggregate. The term "tack oil" will be taken to mean asphaltic cements, liquid asphalts, and asphalt emulsions of the type carried in the separate tack oil tank 59. The body is commercially available from H. D. Industries, Inc., Jacksonville, TX, as the model TCM 415-160 pothole patcher and will be described briefly below.

The top of the hopper compartment 15 is open, and is covered with an insulated tarp during use. A heat transfer oil tank 19, which is also V-shaped, is located immediately below the bottom wall 17 of the hopper compartment 15. The heat transfer oil tank 19 includes a top wall 21 which is contiguous with the bottom wall 17 of the hopper compartment 15. The heat transfer oil tank 19 is heated by a retort tube propane burner 23. The propane burner has an electronic igniter system and is preferably thermostatically controlled with a built in safety shut off to prevent overheating. The tank can also be equipped with an electric heating system to be used when asphalt mix materials are left in the hopper overnight or over the weekend.

The asphalt mix in the hopper compartment 15 is unloaded with a hydraulically driven screw conveyor 37 which is mounted in suitable bearings 39, so as to span an opening (43 in FIG. 1) into the hopper compartment. The screw conveyor 37 is driven by a motor (not shown) which can be driven by a power takeoff mounted directly to the truck transmission. An asphalt agitator shaft 47 having paddles 49 is mounted within the hopper compartment 15 by suitable bearings (51 shown), and by a support bracket 55. The agitator shaft 47 is driven by a hydraulic motor which can be driven by the same pump which supplies power to the screw conveyor. Although shown broken away, the agitator shaft 47 extends the full length of the hopper compartment, and the shaft movement eliminates asphalt sticking or bridging above the screw conveyor 37.

A separate tack oil tank 59 is mounted on the portable base at one end of the hopper compartment 15 for transporting and dispensing tack oils including road oils, cutbacks, asphaltic cements, liquid asphalts and emulsions. The tack oil tank 59 has a bottom wall 61, a top wall 63 and interconnecting sidewalls 65, 67, 69, 71 which together define a closed interior 73. The closed interior is filled with tack oil, by means of a fill cap 74, to a preselected level 75, thereby dividing the tank closed interior into a top region 77 and a bottom region 79, respectively. The level 75 of tack oil is below the top wall 63. A dipstick 81 is provided to monitor the level of tack oil within the tank.

Circulating means, including hydraulic pump 83, are provided within the tank 59 to circulate tack oil from the bottom portion 79 to the top portion 77 thereof. The pump 83 has an inlet conduit 85 for collecting liquid from the bottom portion 79 of the tank and an outlet conduit 87 leading to the top portion 77. The outlet conduit 87 has a junction 89 which connects a hand held spray wand 91. A valve located at the junction 89 controls the supply of liquid to the spray wand 91.

The junction 89 also has an outlet 93 which leads to a dispensing means 95 for dispensing the recirculated tack oil downwardly within the tank interior onto the top of the liquid level 75 therein, to thereby maintain the tack oils within the tank 59 in the emulsified state. Preferably, the dispensing means 95 comprises a spray bar which communicates with the outlet 93 of the pump 83. The spray bar 95 is mounted within the closed interior 73 in the top portion 77 thereof in a horizontal plane generally parallel to the plane of the top wall 63. The spray bar 95 has a plurality of apertures for dispensing recirculated liquid downwardly onto the top of the liquid level within the tank. The pump 83, inlet conduit 85, outlet conduit 93 and spray bar 95 are all enclosed within the interior of the tank 59 and are insulated by the tank walls.

Figure 2:
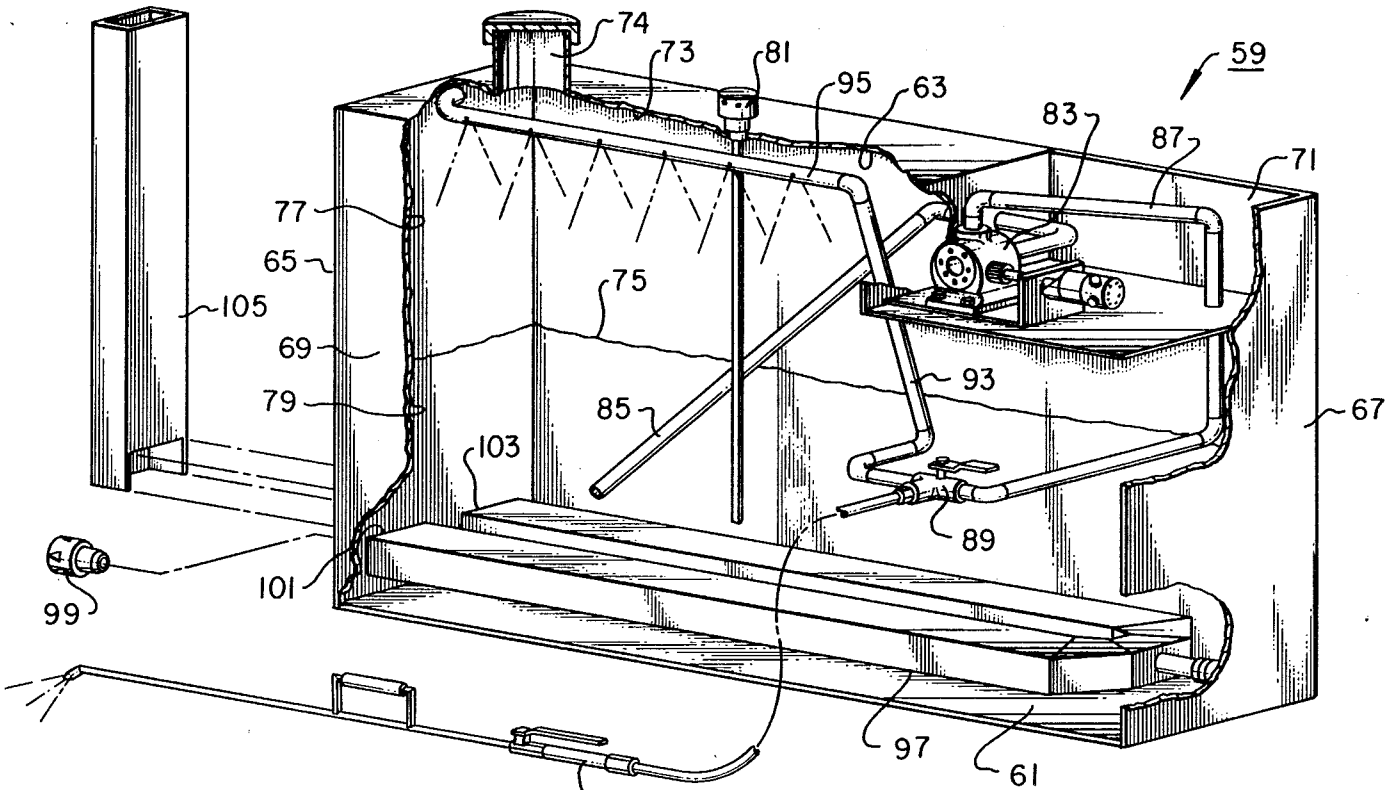
FIG. 2 is an isolated view of the tack oil tank with portions of the exterior broken away to better illustrate the internal components thereof.

Heat transfer means located within the tank 59 heat the tack oil to thereby maintain the tack oil in a liquid state. Preferably, the heat transfer means includes an internally submerged retort tube 97 which is heated by a thermostatically controlled gas burner 99. As shown in FIG. 2, the retort tube 97 is provided in the shape of a horizontal "U" having a pair of outlets 101, 103 to the exterior of the tank 59. Outlet 101 has the burner 99 mounted therein while the other outlet 103 is joined to an external exhaust conduit 105 which is mounted in vertical fashion on the side of the tank.

The operation of the combined units 13, 59 will now be described. The heat transfer oil in the tank 19 is heated by the propane burner 23 which, in turn, heats the asphalt mix in the hopper compartment 15. The tack oil in the tack oil tank is being continuously recirculated by means of the pump 83 and spray bar 95 so that tack oil is dispensed downwardly within the tank 59 onto the top of the liquid level 75 therein to maintain the tack oils in an emulsified state. The retort tube 97 and heater 99 heat the liquid in the tank 59 to maintain the tack oil in a liquid state. At the job site the cavity to be repaired is dressed, as with a hydraulic jack hammer, and valve 89 is opened so that hand-held wand 91 is supplied with liquid asphalts or emulsions to seal and tack the dressed cavity. The screw conveyor 37 is then actuated to dispense asphalt mix materials from the hopper compartment 15 through a discharge chute into the cavity as required. The filled cavity can then be compacted with a hydraulic tamper to complete the job.

While an invention has been shown in only one of its forms, it is not thus limited but is susceptible to various changes and modifications without departing from the spirit thereof.

I claim:

1. An improved tack oil dispensing apparatus of the type used in repairing potholes in asphalt pavements, the apparatus comprising:

a tack oil tank adapted to be mounted on a portable base for transporting the tank to a repair site, the tack oil tank having a bottom wall, a top wall and interconnecting sidewalls which together define a closed interior having a bottom region and a top region, respectively, the closed interior being supplied with a preselected level of tack oil which comprises a liquid-liquid emulsion, the level of the tack oil being below that of the top wall;

circulating means within the tack oil tank for continuously circulating tack oil from the bottom portion of the closed interior to the top portion thereof, the circulating means including dispensing means for dispensing the recirculated tack oil downwardly within the tank interior onto the top of the liquid level therein, to thereby maintain the tack oils within the tank in an emulsified state;

heat transfer means located within the tack oil tank for heating the tack oil to thereby maintain the tack oil in a liquid state; and wherein the circulating means located within the tack oil tank includes a pump having an inlet conduit for collecting liquid from the bottom portion of the tank and an outlet conduit leading to the top portion thereof and wherein the dispensing means comprises a spray bar which communicates with said outlet conduit, said spray bar having a plurality of apertures for dispensing recirculated liquid downwardly onto the top of the liquid level within the tank.

2. The apparatus of claim 1, wherein the spray bar is mounted within the closed interior in the top portion thereof in a horizontal plane generally parallel to the plane of the top wall and wherein the spray bar apertures are oriented vertically downward in the direction of the level of tack oil contained within the tack oil tank.

3. The apparatus of claim 2, wherein the outlet conduit from the pump has a junction therein for attaching a spray wand and a two way valve which controls the supply of recirculated liquid to the spray wand.

4. The apparatus of claim 3, wherein the pump, inlet conduit, outlet conduit and spray bar are all enclosed within the interior of the tank.

5. The apparatus of claim 4, wherein the tack oil tank is supplied with a tack material selected from the group consisting of emulsion oils and liquid asphalt oils.

6. The apparatus of claim 5, wherein the heat transfer means located within the tack oil tank includes an internally submerged retort tube which is heated by a thermostatically controlled gas burner.

7. The device of claim 6, wherein the retort tube is provided in the shape of a horizontal U having a pair of outlets to the exterior of the tank, one of the outlets having the burner mounted therein and the other of the outlets serving as an exhaust conduit.

8. A portable device for transporting asphalt repair materials for use in repairing potholes in asphalt pavements comprising, in combination:

a body adapted to be mounted on a portable base for transporting the body to a repair site, the body having a hopper compartment with a V-shaped bottom wall for transporting asphalt mix materials and a generally V-shaped heat transfer oil tank located below the bottom wall of the hopper compartment in contact with the bottom wall;

a screw conveyor mounted in the bottom of the hopper compartment for dispensing asphalt mix materials therefrom;

a paddle shaft located above the screw conveyor in the hopper compartment for agitating the hopper materials;

a heating means associated with the heat transfer oil tank for heating the tank and for transferring heat to the hopper compartment through the hopper bottom wall to maintain the asphalt mix materials in a workable state;

a separate tack oil tank mounted on the portable base for transporting and dispensing tack oils, the tack oils comprising a liquid-liquid emulsion and being dispensed to dress the pothole prior to dispensing the asphalt mix materials, the tack oil tank having a bottom portion and a top portion, respectively and being supplied with a preselected level of tack oil;

circulating means within the tack oil tank for continuously circulating tack oils from the bottom portion of the tank to the top portion thereof, the circulating means including dispensing means for dispensing the recirculated tack oil downwardly within the tank interior onto the top of the liquid level therein, to thereby maintain the tack oils within the tank in an emulsified state;

heat transfer means located within the tack oil tank for heating the tack oil within the tack oil tank to maintain the tack oil in a liquid state; and a hand held wand connected to the tack oil tank by a conduit for dispensing tack oil from the tack oil tank; and wherein the circulating means located within the tack oil tank includes a pump having an inlet conduit for collecting liquid from the bottom portion of the tank and an outlet conduit leading to the top portion thereof, wherein said dispensing means comprises a spray bar which communicates with said outlet conduit, said spray bar having a plurality of apertures for dispensing recirculated liquid downwardly onto the top of the liquid level within the tank, and wherein the outlet conduit from the pump has a junction therein for attaching the hand held wand and a two way valve which controls the supply of recirculated liquid to the hand held wand.

9. The device of claim 8, wherein the tack oil tank is filled with a tack material selected from the group consisting of emulsion oils and liquid asphalt oils.

10. The device of claim 9, wherein the heat transfer means located within the tack oil tank includes an internally submerged retort tube which is heated by a thermostatically controlled gas burner.

11. The device of claim 10, wherein the retort tube is provided in the shape of a horizontal U having a pair of outlets to the exterior of the tank, one of the outlets having the burner mounted therein and the other of the outlets serving as an exhaust conduit.

12. A method of repairing a pothole in an asphalt pavement, comprising the steps of:

providing a body on a portable base for transporting the body to a repair site, the body being equipped with a hopper compartment with a bottom wall for transporting asphalt mix materials and a heat transfer oil tank located below the bottom wall of the hopper compartment in contact with the bottom wall;

using a heater to heat the heat transfer oil so that the asphalt mix materials in the hopper compartment are heated by the transfer of heat through the bottom wall;

providing a separate tack oil tank mounted on the portable base for transporting and dispensing tack oils which comprise liquid-liquid emulsions, the tack oil tank having a bottom portion and a top portion, respectively and being supplied with a preselected level of tack oil;

continuously recirculating the tack oil within the tack oil tank through a conduit from the bottom portion of the tank to the top portion thereof, including the step of spraying the recirculated tack oil downwardly through a spray bar mounted in communication with the conduit within the tank interior onto the top of the liquid level therein, to thereby maintain the tack oils within the tank in an emulsified state;

attaching a hand held wand to the tack oil tank in communication with the circulation conduit and providing a two way valve in the conduit for controlling the supply of recirculated tack oil to the hand held wand;

dispensing the tack oil from the tack oil tank through the hand held wand onto the pothole to be repaired in order to prepare the surface thereof; and dispensing asphalt mix materials from the hopper compartment to fill and repair the pothole.

* * * * *